US005354140A

United States Patent [19]

Diakoulas

[11] Patent Number: 5,354,140

[45] Date of Patent: Oct. 11, 1994

[54] COVERED WRITING INSTRUMENT, AND PROCESS FOR MAKING SUCH WRITING INSTRUMENT

[76] Inventor: Michael J. Diakoulas, 132 Othoridge Rd., Lutherville, Md. 21093

[21] Appl. No.: 138,756

[22] Filed: Oct. 18, 1993

[51] Int. Cl.[5] ..... B43K 29/00; B43K 7/00

[52] U.S. Cl. ..... 401/6; 401/88; 401/209; 273/81.5

[58] Field of Search ..... 401/88, 6, 209, 96, 401/97; 63/1.1; 273/81.5

[56] References Cited

U.S. PATENT DOCUMENTS

| | | | |
|---|---|---|---|
| 22,524 | 6/1893 | Ecker et al. . | |
| 138,825 | 9/1944 | Waldinger | D74/24 |
| 170,539 | 10/1953 | Lovejoy | D74/17 |
| 798,749 | 9/1905 | Rose | 401/88 |
| 1,131,786 | 3/1915 | Morrison . | |
| 1,162,732 | 11/1915 | Draeger | 401/88 X |
| 1,582,242 | 4/1926 | Booty | 401/97 |
| 1,950,960 | 3/1934 | Wisser | 401/209 X |
| 2,266,942 | 12/1941 | Wallace | 63/1.1 |
| 3,140,873 | 7/1964 | Goodwin | 273/81.5 |
| 4,852,823 | 8/1989 | Adams et al. | 242/125.1 |
| 5,203,182 | 4/1993 | Wiriath | 401/88 X |

FOREIGN PATENT DOCUMENTS

| | | | |
|---|---|---|---|
| 1177959 | 4/1959 | France | 401/209 |
| 618124 | 2/1961 | Italy | 401/209 |
| 373981 | 1/1964 | Switzerland | 401/209 |
| 2255531 | 11/1992 | United Kingdom | 401/209 |

*Primary Examiner*—Steven A. Bratlie
*Attorney, Agent, or Firm*—Leonard Bloom

[57] ABSTRACT

A writing implement (10) has a hollow housing (11) having a front end (12) and back end (13) wrapped with at least one strand (18) having a leading end (21) and a trailing end (22), which strand ends are retained within the housing (11). The writing implement (10) is thereby decorated, while also being durable, easy to use, and having an improved covered grip surface (14). The wrapping of at least one strand (18), or a plurality of strands (18, 19), around the housing (11) is accomplished in an inexpensive and simple method.

6 Claims, 6 Drawing Sheets

COVERED WRITING INSTRUMENT, AND PROCESS FOR MAKING SUCH WRITING INSTRUMENT

FIELD OF THE INVENTION

The present invention relates to writing instruments, and more particularly, to a covered writing instrument and to a means for making such a covered writing instrument.

BACKGROUND OF THE INVENTION

Writing instruments are used in the ordinary course of school, work, social activities, and other matters, by children and adults. Multitudinous activities require use of a writing implement, such as writing invitations, homework, shopping lists, drafts, checks, diaries, phone messages, job applications, government forms, correspondence, and other materials.

Typical pens used by school children have a plain plastic housing or barrel containing an ink source. Such plain pens do not contain decorative features attractive to school children; hence are not likely to interest school children to use their pens to take notes, write assignments, and do their homework. Decoration of writing implements, of course, is not limited to appealing to school children. Expensive writing instruments made of valuable materials or artistically sculpted have been developed.

Since at least the 1800's, there have been various efforts to decorate writing instruments, for decorative and other purposes. For example, U.S. Pat. No. (Des.) 22,524 (issued to Ecker et al. on Jun. 13, 1893) discloses a design for a penholder handle with an unspecified spiral wrapping partially covering the surface of a penholder handle. U.S. Pat. No. 1,131,786 (issued to Morrison on Mar. 16, 1915) discloses a pencil covered with a wound paper sheet, which piecewise is unwrapped to expose lead, where an advertising message written on the paper sheet is revealed upon unwrapping the paper sheet. U.S. Pat. No. (Des.) 138,825 (issued to Waldinger on Sep. 19, 1944) discloses a design for a mechanical pencil with spiral decorations as part of the surface of the pencil near its writing and back ends. U.S. Pat. No. (Des.) 170,539 (issued to Lovejoy on Oct. 6, 1953) discloses a design for a ballpoint pen, with a spaced spiral pattern formed inside the casing of the pen, and which has a smooth exterior gripping surface. Other efforts to decorate writing instruments have included placing advertising and other messages on the barrels of pens and pencils, and adorning the eraser ends of pencils with cartoon characters or other creatures.

Such various decorated writing instruments are unwieldy, difficult to produce, difficult to use, costly, decorative at the expense of being unduly distracting or unwieldy, flimsy, and/or of limited decorative interest.

Additionally, problems occur with prior art pens, for some users, in finding a pen which they can comfortably grip and with which they can write legibly and for the desired period of time. Even healthy people not suffering from any hand-related disability sometimes find gripping certain pens, after a period of time, to be uncomfortable or painful. Additionally, many people suffer from disabilities, such as carpal tunnel syndrome and other medical conditions, which impair gripping and use of conventional writing instruments. As a result, these individuals find themselves unable to write using prior art instruments, limited in the amount of time they can write, or writing illegibly. It thus is desirable to provide for these users alternate gripping surfaces, barrel shapes, and other physical features.

On the other hand, and for completely different purposes than in writing implements, "telephone" wire has been used. Such wire is available in lengths of metal wire covered by various-colored insulating material. The insulating material may be cut or stripped from the metal wire at any point, to expose metal wire. Parts of exposed metal wire have a substantially smaller diameter than parts of insulated wire. Such telephone wire is commercially available. Similarly, "computer" wire and cords of various materials are commercially available but used for different purposes than covering writing implements. Such telephone wire, computer wire, and cording may be cut into a desired length. Additionally, such wires and cords are flexible and may be wound, bent, and shaped.

Also for completely different purposes than making of writing implements, winding methods have been used. For example, U.S. Pat. No. 4,852,823 (issued to Adams et al. on Aug. 1, 1989) discloses a means for winding colored yarn onto a tube.

Nevertheless, there have existed unfilled needs for providing writing implements appealing to school children and others, for providing a different or improved gripping surface, and for providing a simple and inexpensive means for making such writing implements with decorative features and with an improved gripping surface. It is desired to provide a pen which is decorative and appealing to school children, not unduly distracting, easy to use, durable, inexpensive and simple to make, and has an improved grip. It further is desired to provide an inexpensive and simple means for making such a writing implement.

SUMMARY OF THE INVENTION

Accordingly, it is an object of the present invention to provide a decorative writing implement appealing to school children and others, while being appropriate for use in educational, business and other settings, easy to use, durable, and simple and inexpensive to manufacture.

It is a further object of the present invention to provide a writing implement with an improved gripping surface, which at the same time is decorative, durable, and simple and inexpensive to manufacture.

It is a further object of the present invention to provide a simple and inexpensive means for making a writing instrument which is decorative, easy to use, durable, appropriate for use in any setting, and has an improved grip.

The present invention is applied to a writing implement having an unwrapped housing, the improvement comprising at least one strand being wrapped around the housing.

A further embodiment is applied to a writing implement having a housing which contains an ink cartridge, wherein the ink cartridge has a front writing tip which protrudes from the housing. The housing at its back end receives a cap. The housing has an exterior unwrapped surface. The improvement of the present invention includes at least one strand wrapped around the housing (and anchored both at the front writing tip and at its back and which receives the cap).

The improved writing implement may have a plurality of strands wrapped around the housing. In one embodiment, at least two strands are wrapped around the housing, with adjacent strands having no gap between each other. The two strands may be separate or joined.

In the improved writing implement, strands may consist of wire. In one embodiment, the strands consist of telephone wire.

In one embodiment, each strand consists of colored insulation-covered wire. A strand may consist of a plurality of wires covered with insulation. In another embodiment, each strand may be selected in a particular color, such as school colors, colors of an athletic team, or colors associated with a business.

In another embodiment, each strand consists of colored insulation-covered telephone wire which is bare of insulation where contained within the housing.

In one embodiment, the writing implement is a ballpoint pen. In a preferred embodiment, the invention consists of a ballpoint pen having a front portion and a rear portion and including a barrel further having a reservoir of ink therebetween. A writing tip is at the front portion of the barrel and connected to the reservoir. A cap is at the rear portion of the barrel. At least one strand is wound spirally around the barrel, the strand having a pair of ends. One of the strand ends is retained between the writing tip and the barrel, and the other end is retained between the cap and the barrel. In another embodiment, a pair of strands are wound tightly and spirally around the barrel of a ballpoint pen. In another embodiment, the strands are multi-colored. In another embodiment, the strands comprise telephone hook-up wire.

The present invention further is applied to a method for making an improved writing implement, using at least one strand, each strand having a forward end and a trailing end, and further using a housing, an ink cartridge for insertion into the housing, and a cap for fitting onto the housing. The method includes the step of inserting the forward end of at least one strand into the housing, so that after insertion of the forward end there remains a free length of strand for wrapping and an unattached trailing end for each strand. This method further has the step of inserting the ink cartridge into the housing so that the inserted ink cartridge anchors each inserted forward end. Another step of the method is wrapping each free strand around the housing. The method has as another step inserting the trailing end of each strand into the back end of the housing. A further step is inserting the cap into the housing so that the inserted cap is in close communication with each inserted strand. The product of the method is a covered writing implement which is durable and decorative.

In another embodiment, in making the wrapped writing implement, each strand consists of colored insulated telephone wire which has a short length of its forward end bare of insulation. This embodiment further includes the step of stripping a short length of each trailing end of insulation prior to its insertion into the housing.

These and other objects of the present invention will become apparent from a reading of the following specification taken in conjunction with the enclosed drawings.

GENERAL DESCRIPTION OF THE PREFERRED EMBODIMENTS

Figure 1:
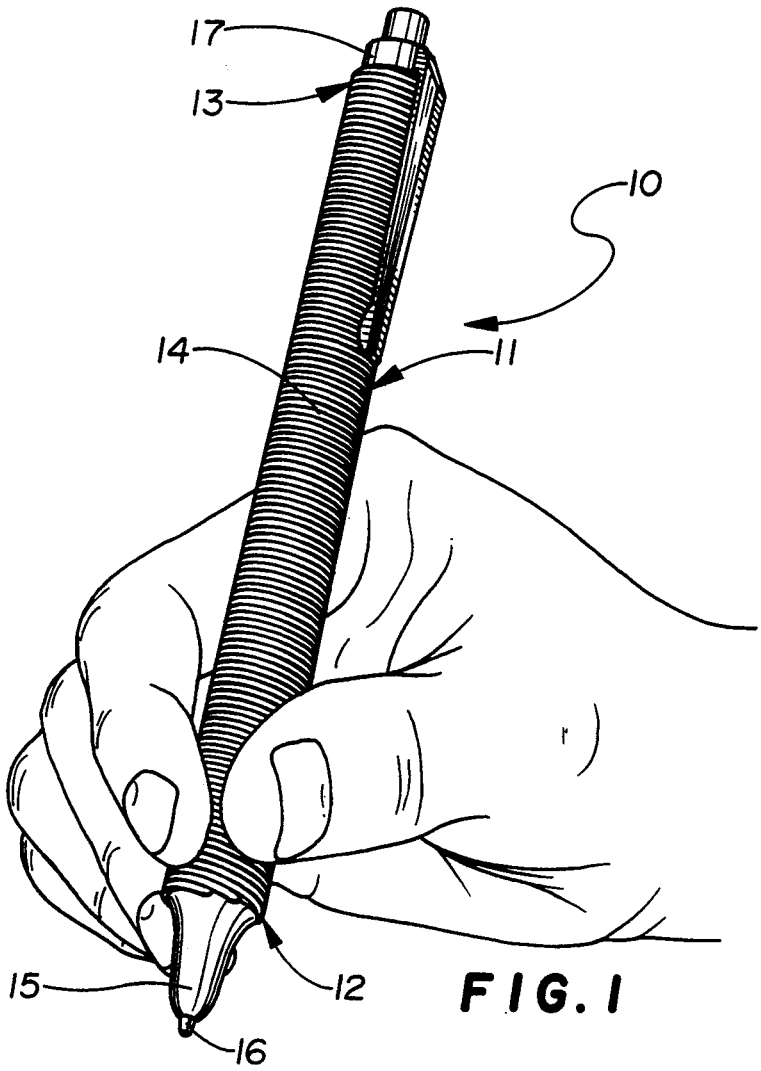
FIG. 1 is a view of a person holding a covered pen according to the present invention.
Figure 2:
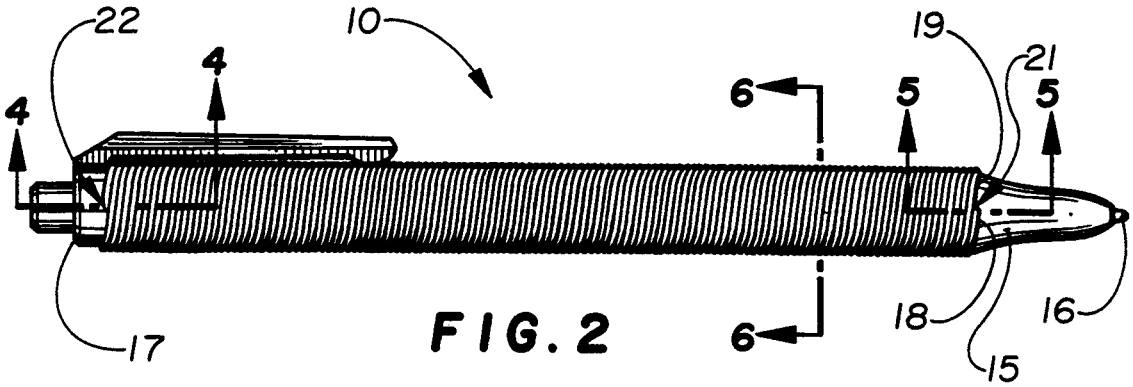
FIG. 2 is a longitudinal side elevation view of a first embodiment of the present invention.
Figure 3:
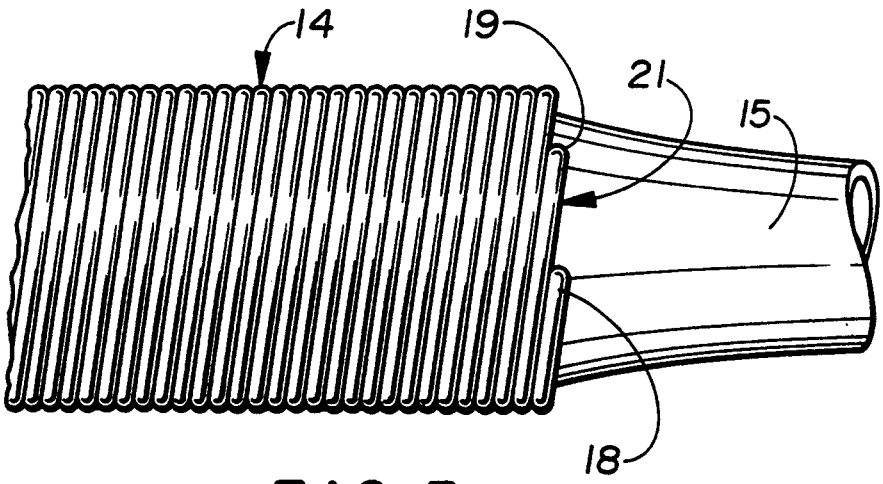
FIG. 3 is a portion of FIG. 2, drawn to an enlarged scale and showing the strands covering the pen.

With reference to FIGS. 1 and 2, a first embodiment 10 of the present invention includes a hollowed-out housing 11, with a front end 12 and back end 13. The embodiment has a covered grip surface 14. The housing 11 contains an ink cartridge or ink source 15, which has a writing tip 16 which protrudes from the housing 11. The housing 11 at its back end 13 receives a cap 17. A first strand 18 and a second strand 19 are wrapped around the housing 11. As shown in FIG. 3, the strands 18 and 19 of the first embodiment of the present invention are in close communication with each other, without overlapping or crossing over each other.

Figure 4:
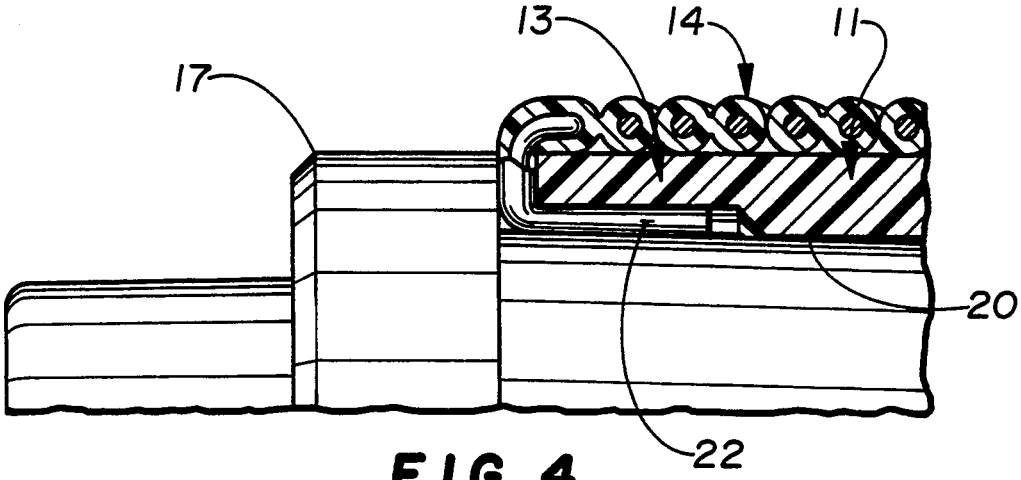
FIG. 4 is a longitudinal sectional view of the improved pen taken along the lines 4—4 of FIG. 2, and drawn to an enlarged scale.
Figure 5:
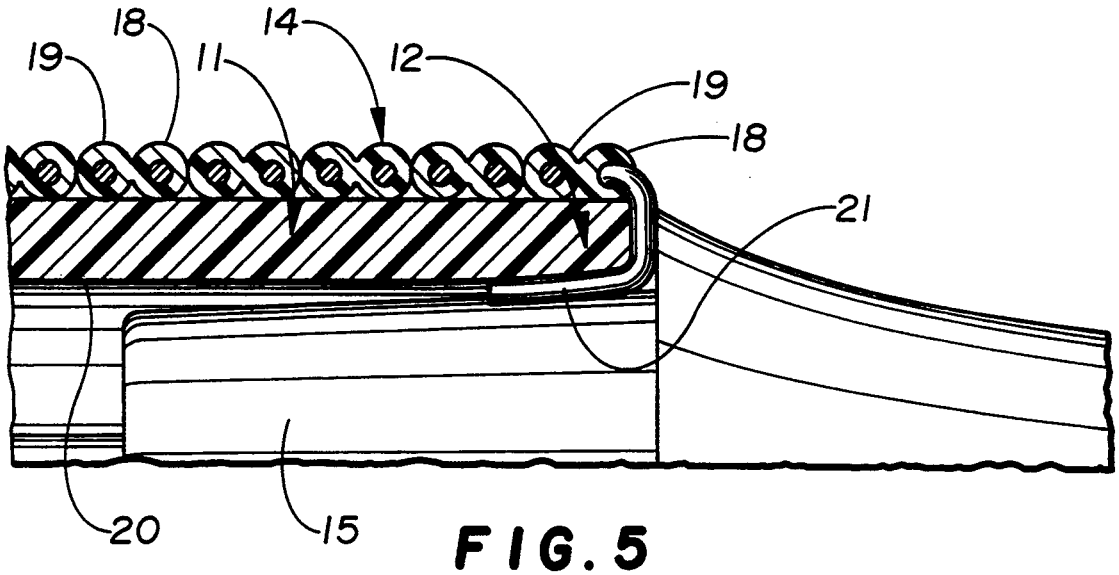
FIG. 5 is a longitudinal sectional view of the improved pen taken along the lines 5—5 of FIG. 2, and drawn to an enlarged scale.

As shown in FIGS. 4 and 5, the strands 18 and 19 are wrapped around the housing 11. The hollow housing has an interior surface 20. Each strand has a leading end 21 and a trailing end 22 which are bent back and contained within the housing 11 where the ends are retained against the housing interior surface 20. Each leading strand end 21 is retained between the ink cartridge 15 and the housing 11, as shown in FIG. 5. Each trailing strand end 22 is retained between the cap 17 and the housing interior surface 21, as shown in FIG. 4.

Figure 6:
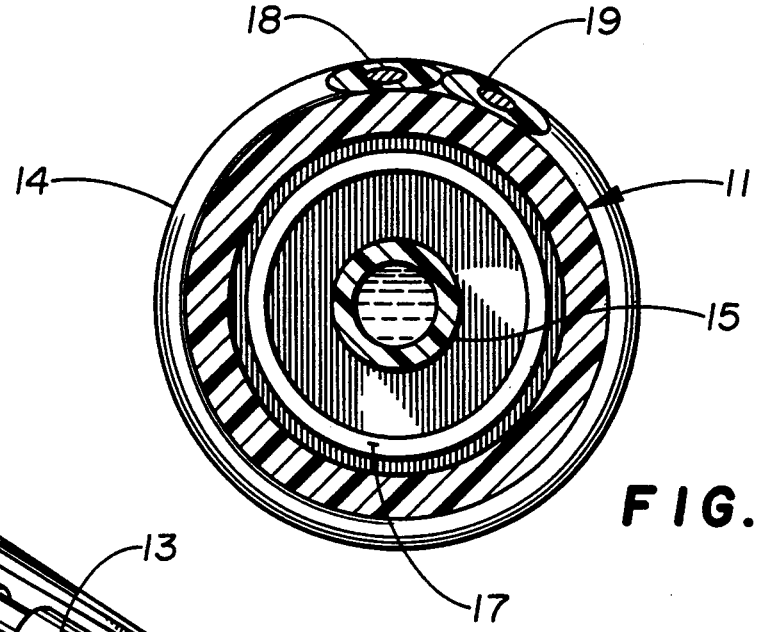
FIG. 6 is a sectional view of the improved pen taken along the lines 6—6 of FIG. 2, and drawn to an enlarged scale.

With reference to FIG. 6, the strands 18 and 19 are wrapped around the housing 11, forming a covered grip surface 14. The hollow housing has a housing interior surface 20. Within the hollow housing is the ink source 15.

Figure 7:
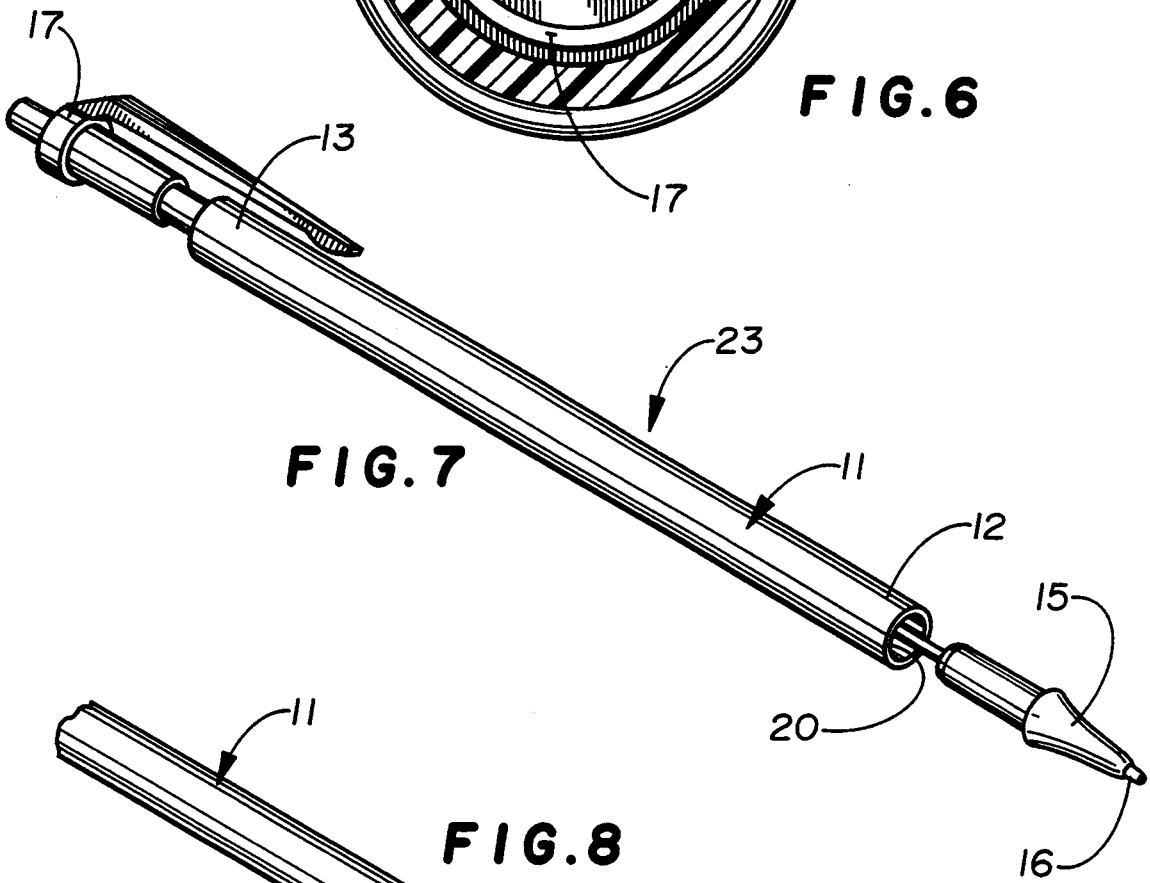
FIG. 7 is an exploded perspective view of a prior art ballpoint pen.
Figure 8:
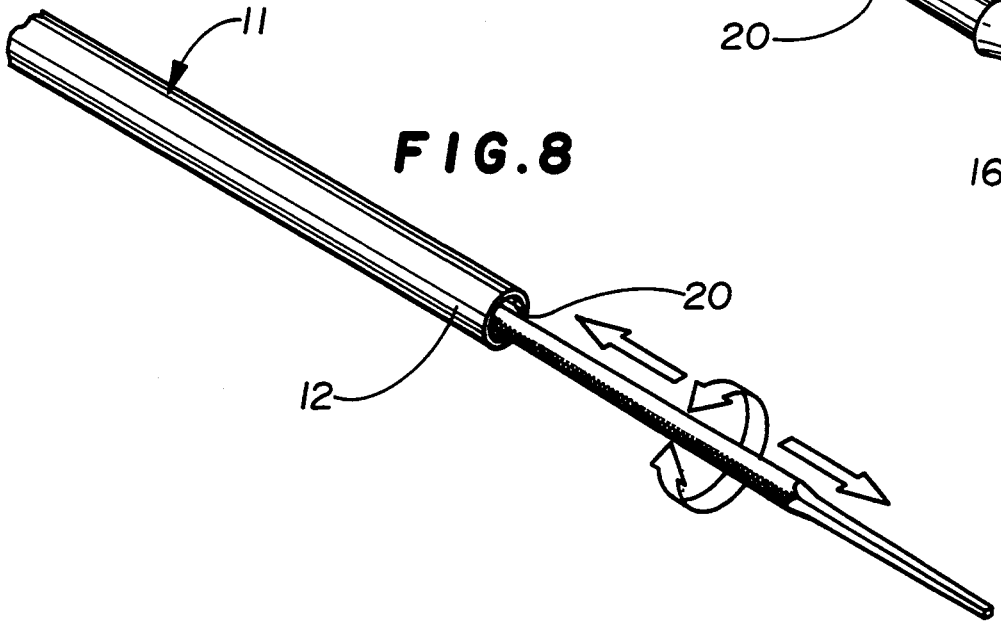
FIG. 8 is a perspective view of the interior of the housing of the pen of FIG. 7 being filed.

With reference to FIGS. 7 through 12, a pen according to the present invention may be made simply and inexpensively. Like numbers are used in FIGS. 7 through 12 to identify elements corresponding to FIGS. 1 through 6. As shown in FIG. 7, the method may be practiced using a prior art ballpoint pen 23 having a hollow housing 11, from which the ink cartridge 15 and cap 17 have been removed. As shown in FIG. 8, the housing 11 is then filed at the front end 12, to prepare the housing 11 to receive each leading strand end 21.

Figure 9:
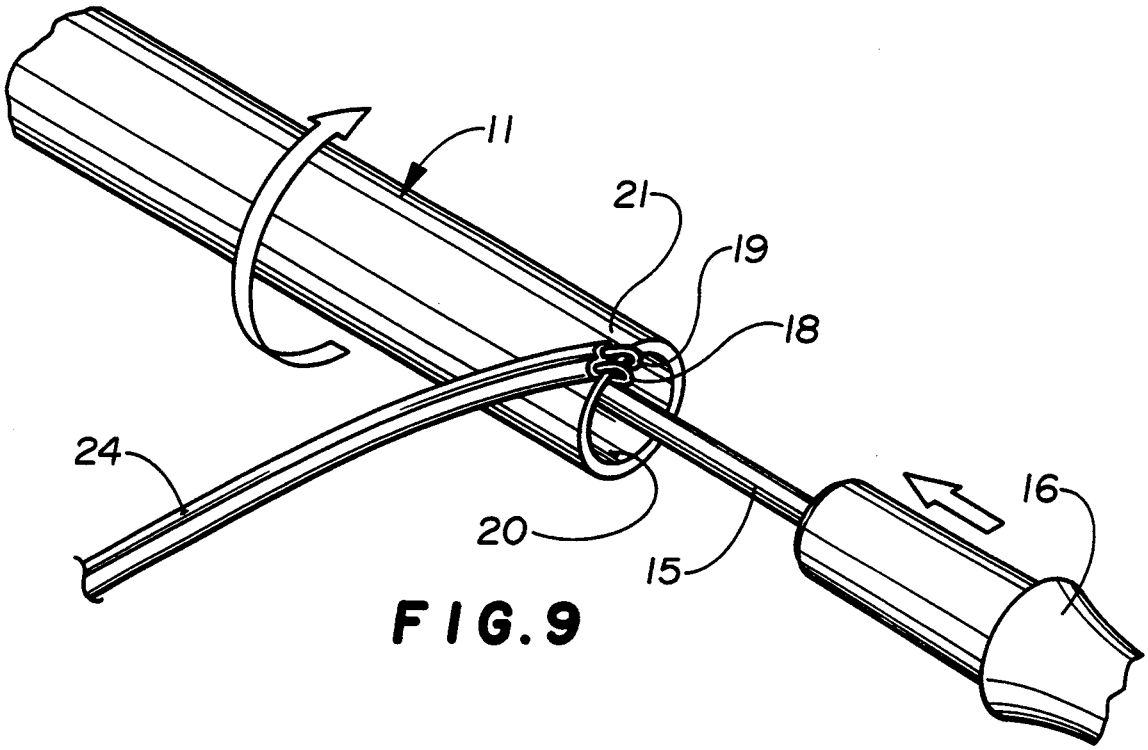
FIG. 9 is a perspective view of two insulated strands which have been stripped at their bent-back ends inserted into the front end of the housing of FIG. 8, and the ink cartridge being reinserted.

As shown in FIG. 9, a first and a second strand 18 and 19 covered with insulation 24, are used in the method, after each strand 18 and 19 has been stripped of insulation 24 at its leading end 21, and bent back at its leading end 21. Strands 18 and 19 are chosen in contrasting or coordinating colors, such as school colors. The bent and stripped leading wire ends 21 are inserted into the housing 11 at the housing front end 12. The ink cartridge 15 is then inserted into the housing 11 at the housing front end 12, so that the writing tip 16 protrudes from the housing 11 and so that the inserted leading strand ends 21 are retained between the ink cartridge 15 and the housing interior surface 20. The uninserted strands 18 and 19 are left covered with insulation 24. After replacement of the ink cartridge 15 to secure the leading strand ends 21, as shown in FIG. 9, wrapping of the strands 18 and 19 around the housing 11 is begun.

Figure 10:
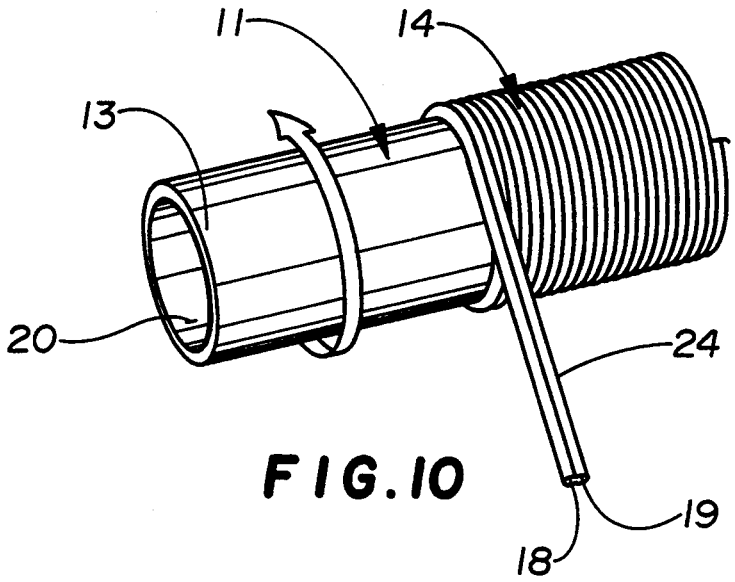
FIG. 10 is a perspective view of a housing partially wrapped with two adjacent strands.

Wrapping may be accomplished manually, or by inserting the back end of the housing into a mechanical instrument for rapidly rotating the housing. As the wrapping process progresses, the covered grip surface 14 is formed, as shown in FIG. 10. Throughout the wrapping process, strands 18 and 19 remain adjacent to each other.

Figure 11:
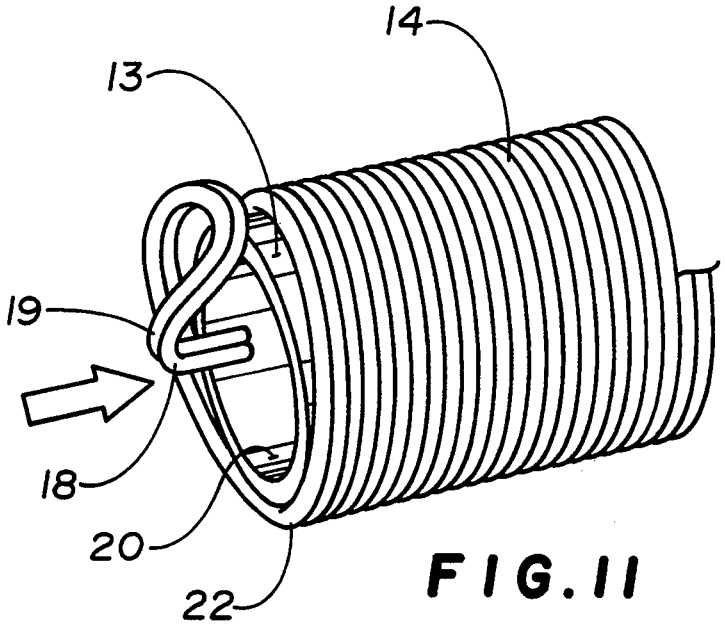
FIG. 11 is a perspective view of a fully wrapped housing, with bent-back strand ends.

When, as shown in FIG. 11, the housing 11 is almost completely wrapped with the two strands 18 and 19, the trailing ends 22 are cut so that they are insertable into the housing 11. The trailing ends 22 are bent back as shown in FIG. 11, and stripped of insulation 24. The trailing ends 22 are inserted into the housing 11 through the housing back end 13.

Figure 12:
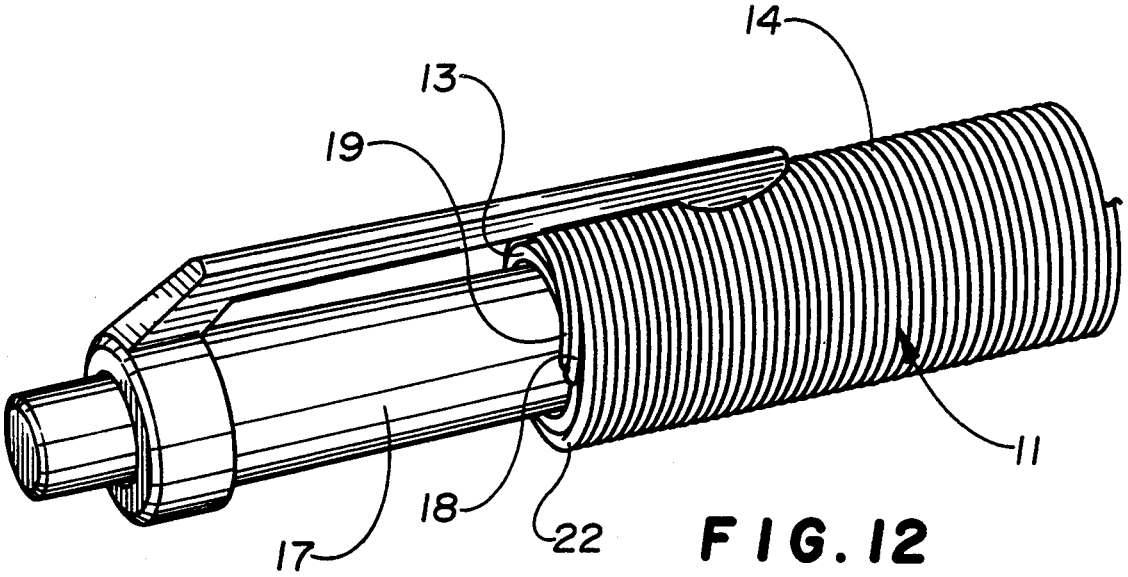
FIG. 12 is a perspective view of a partially-inserted cap being returned into a fully-wrapped housing.

As shown in FIG. 12, the cap 17 is inserted into the housing 11 at the housing back end 13, so that each inserted trailing strand end 22 is retained between the inserted cap 17 and the housing interior surface 20, as shown in FIG. 4. The result of the method is a covered and decorated writing implement, with an improved grip surface 14.

Figure 14:
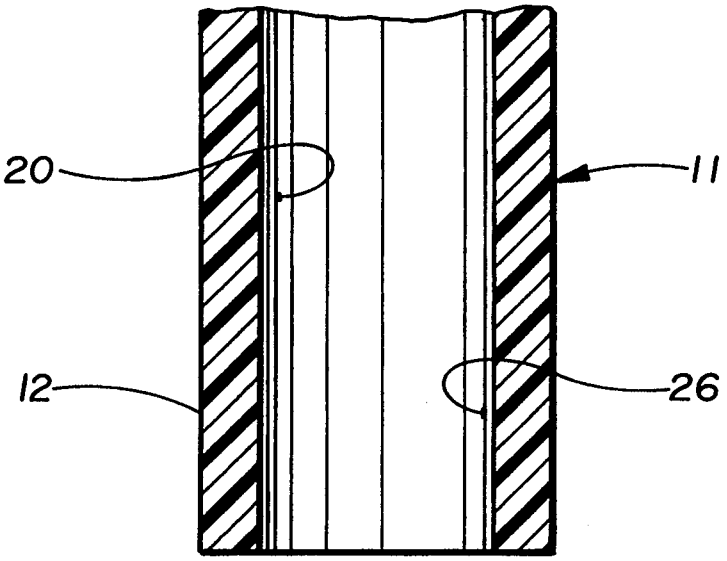
FIG. 14 corresponds substantially to a portion of FIG. 13, but shows the completed reaming operation.
Figure 13:
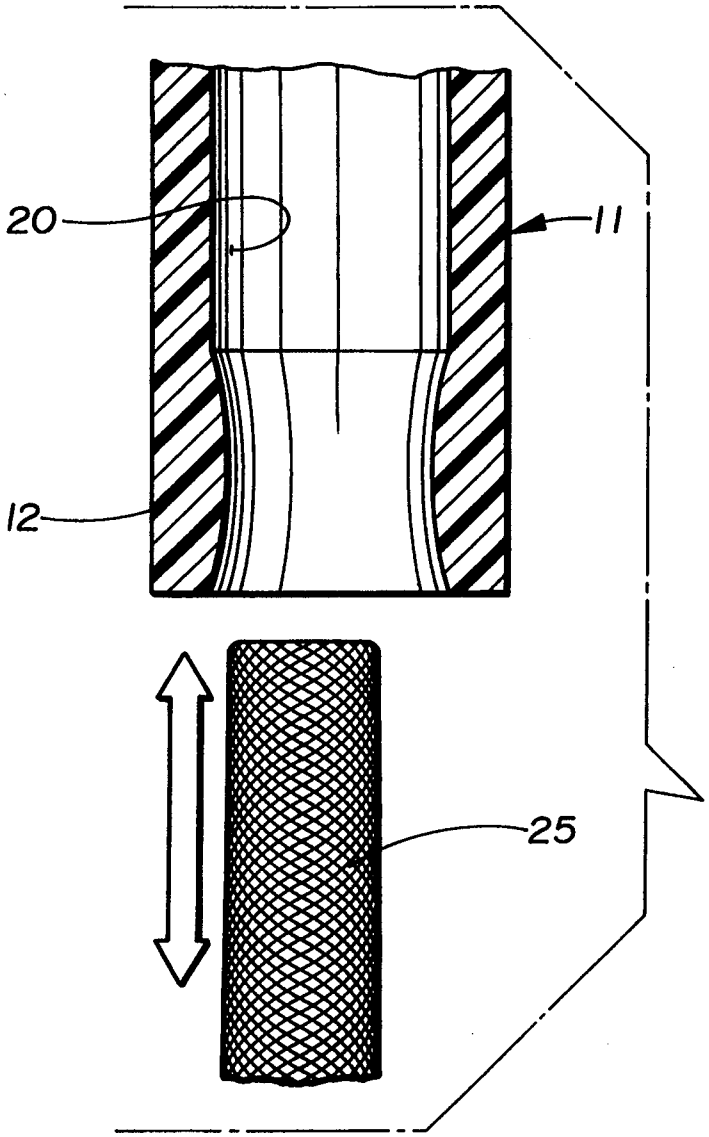
FIG. 13 is a longitudinal sectional view of the front end of a typical pen formed from a relatively hard plastic material, showing a suitable file (or other implement or tool) in exploded relationship thereto for reaming out a portion of the material to form a substantially smooth bore.

In some cases, the plastic material of the barrel or tip portion of the ballpoint pen is relatively pliable, so that the strands or wires may be fitted into the pen and retained securely therein. In other cases, however, the plastic material is relatively rigid. This situation is illustrated in FIGS. 13 and 14. In FIG. 13, the housing or barrel 11 is being reamed out by a rotary file 25 (or other suitable implement) to form a smooth bore 26, as shown more clearly in FIG. 14. It will be appreciated, however, that the teachings of the present invention are not necessarily confined thereto but, rather, are equally applicable to a wide variety of pens and other writing implements.

Obviously, many modifications may be made without departing from the basic spirit of the present invention. For example, the pen may be covered with insulated telephone wire, nylon cording, computer wire, twine, or other colored strands. Various numbers of strands may be used for wrapping the housing. The strands may themselves be further decorated, with material affixed or threaded onto the strands. Accordingly, it will be appreciated by those skilled in the art that within the scope of the appended claims, the invention may be practiced other than has been specifically described herein.

What is claimed is:

1. In a writing element having a front portion and a rear portion and including a hollow barrel further having a reservoir of ink therebetween, a writing tip at the front portion of the barrel and connected to the reservoir, and a cap at the rear portion of the barrel, the improvement which comprises at least one strand of coated wire wound spirally around the barrel, the strand having a pair of ends, one end of which being bent back into the hollow barrel and being retained between the writing tip and the barrel, and the other end of which being bent back into the hollow barrel and being retained between the cap and the barrel, thereby providing a decorative ballpoint pen with an improved gripping surface.

2. The improvement of claim 1, wherein a pair of strands of coated wire are wound tightly and spirally around the barrel.

3. The improvement of claim 2, wherein the stands of coated wire are multi-colored.

4. The improvement of claim 3, wherein the strands of coated wire comprise telephone hook-up wire.

5. A writing element comprising a hollow barrel having an inside surface, a front portion and a rear portion and further having a reservoir of ink therebetween, a writing tip at the front portion of the barrel and connected to the reservoir, and a cap at the rear portion of the barrel, and two strands of coated wire wound spirally around the barrel, each strand having a pair of ends, the first end of each strand being bent back into the hollow barrel and being retained between the writing tip and the inside surface of the barrel, and the other end of each strand being bent back into the hollow barrel and being retained between the cap and the inside surface of the barrel.

6. The writing element of claim 5, wherein the two stands of coated wire have respective coatings of a different color, thereby enhancing the decorative effect, and wherein the two strands of coated wire are wound closely adjacent to each other, thereby enhancing the available grip and feel of the pen.

* * * * *